US006392130B1

(12) United States Patent
Carlson

(10) Patent No.: US 6,392,130 B1
(45) Date of Patent: May 21, 2002

(54) DRUM PEDAL

(76) Inventor: Karl R. Carlson, 412 5th Ave., Fairbanks, AK (US) 99701

( * ) Notice: Subject to any disclaimer, the term of this patent is extended or adjusted under 35 U.S.C. 154(b) by 0 days.

(21) Appl. No.: 09/545,555

(22) Filed: Apr. 7, 2000

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 1,369,233 A * 2/1921 Fitzgerald et al. ..... 84/422.2
4,186,644 A * 2/1980 Kurosaki ..... 84/422.1
4,691,613 A * 9/1987 Jacobson ..... 84/422.1
4,788,897 A * 12/1988 Kirby et al. ..... 84/422.1
4,955,277 A * 9/1990 Carlson ..... 84/422.1
4,976,181 A * 12/1990 Jacobson ..... 84/422.3
5,591,929 A * 1/1997 Wellman ..... 84/422.1

* cited by examiner

*Primary Examiner*—Shih-Yung Hsieh
(74) *Attorney, Agent, or Firm*—Patrick M. Dwyer

(57) ABSTRACT

An improved drum pedal having movable head pivots, a clutch on a beater connect, a compression spring with a bearing mount, a circular ramp (MemoryLock release) for cam adjustment of the drum rim clamp, and a cog belt/cog wheel linkage combination.

2 Claims, 6 Drawing Sheets

DRUM PEDAL

TECHNICAL FIELD

Figure 7:
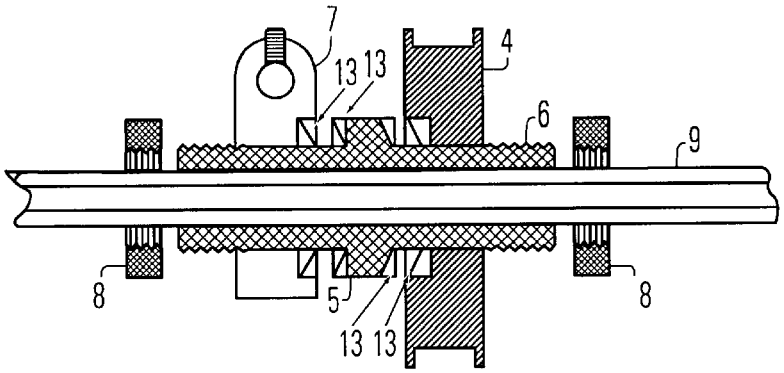

The invention relates generally to foot activated musical drum impacting devices, and more particularly to a device used in conjunction with a musical drum which translates foot motion into motion of a mallet to impact the surface of a drum.

BACKGROUND OF THE INVENTION

Standard foot activated musical drum pedal devices are generally known to include a base, a foot pedal, and a mallet head mechanically linked together to translate foot motion into a drum beating activity. These devices are generally used in connection with a large musical base drum. The pedal device generally is fixed to a bottom portion of the bass drum rim. The musician generally sits back and above the pedal device, and the device is activated by the musician depressing the forward end of the foot pedal which cause the mallet head to impact a surface of the a bass drum.

The velocity of the mallet head as it impacts the drum defines, in part, the quality of the music produced by the drum. In general, the greater the velocity of the mallet as it strikes the drum head, the greater the volume and the sharper the attack of the resulting drum note.

Many known drum pedals directly link the toe end of a foot pedal to a crossarm, supported by a pair of uprights, generally above the toe end of the foot pedal. The linkage may be a flexible member such as nylon cordage that is attached to a rear portion of a curved lever arm with upwardly facing pulley groves, and then wrapped through the pulley grooves over the forward end of the lever arm, and downward to terminate and attach directly at the toe end of the foot pedal. More expensive models replace the lever arm with a sprocket wheel and employ a chain drive as the flexible member. The chain is attached to a rearward portion of the sprocket wheel, wrapped over the top of the wheel and then downward to terminate and attach directly to the toe end of the foot pedal.

The known drum pedals present a compound leverage system whereby the downward motion of a toe end of the drum pedal is converted into a generally arcuate forward swing of the mallet head into an impact collision with the drum head. The leverage system in these known devices converts a downward arcuate velocity of the toe end of the foot pedal into a forward arcuate velocity of the mallet head, generally in a ratio greater than 1:1. That is, the mallet head actually strikes the drum head at a velocity greater than the greatest velocity of the toe end of the pedal as it travels downwardly under the drummer's foot. These known devices provide means to some extent to adjust this ratio, usually by shortening or lengthening the effective length of the mallet handle.

For either type of pedal, the termination and direct attachment of the flexible member at the toe end of the foot pedal however prevents obtaining further mechanical advantage at the foot pedal whereby the downward velocity of the foot pedal can be more greatly amplified to cause the mallet head to strike the drum surface with even greater velocity.

Carlson, U.S. Pat. No. 4,955,277, Sep. 11, 1990, generally discloses an improved drum pedal with means to further magnify the velocity of the downward foot motion of the drummer, thereby further magnifying the velocity of the mallet as the mallet strikes the drum. This is generally effected by having a pulley or sprocket wheel assembly at the toe end of the foot pedal, and by attaching a flexible member to the crossarm lever and passing it down and around the toe end wheel, and then upwardly to a point of attachment, either on the crossarm lever again, or on a second crossbar.

DISCLOSURE OF THE INVENTION

A new system having cog wheel and cog belt for the sprocket or pulley portion and the flexible member of an improved drum pedal is presented. In a preferred embodiment an engine timing wheel and timing belt are employed; they are relatively weightless, noiseless, and very durable. It is also very friendly to current manufacturing processes. This belt and wheel combination is completely slip proof in transferring power from one point to another. It is can be a combination of fabric and rubber molded in such a manner that one surface contains a continuous series of raised ridges or cogs that engage a like shaped set of cogs on a wheel, creating a sure, slipless engagement between belt and wheel.

It is an object of the invention to provide a drum pedal system for drummers who want the ability to alter the beater angle though as much as 345 degrees in preferably around 15 degree increments without altering the pedal angle, and which can be accomplished in seconds.

It is a further object of the invention to provide an egg shaped or eccentric beater cam so that a drummer can rotate this cam on a cross arm shaft independently of any other setting so as to create any desired "feel" of the pedal pressure by altering the radius distance to tangent, thus insuring unlimited options for pedal response, and for the first time provide the drummer with the ability to "fine tune" a bass drum foot pedal to heart's desire.

It is still another object of the invention to provide such an adjustable bass drum pedal which also converts to use as an electronic bass drum activator by simply loosening a lock nut on the beater holder and rotating the arm holder to a desired angle for sensor contact.

It is another object of the invention to provide a beater ball location designed to align with such a sensor without requiring any reshaping or bending of the beater arm.

Figure 1:
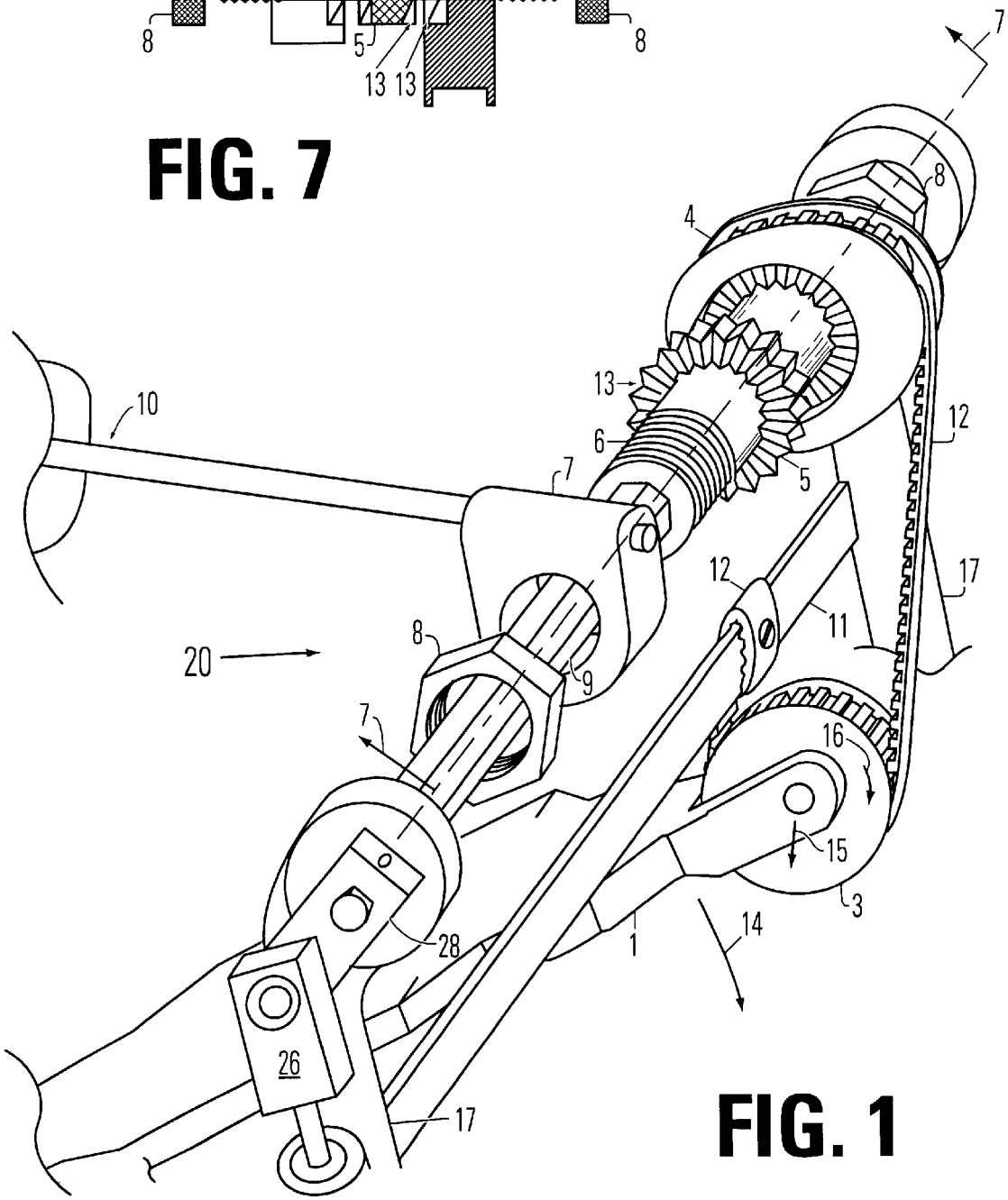

FIG. 1 shows a partially exploded perspective view of a device allowing altering of a bass drum beater shaft in a manner that allows "at rest" positions of both the beater ball and the operating cam to set in any angle independently of each other, for virtually unlimited pedal response setting options.

Down pressure of foot pedal causes pulley wheel A to rotate clockwise causing cogbelt AB, with short end attached to crossarm I, to rotate cam B in a clockwise direction. Ratchet or pawl teeth on the side of cam B engage and releasably interlock with similar pitched pawl teeth on collar C which has been molded to sleeve D which is in turn constructed with hexagon center to fit snugly over hex axle G. Beater holder E, also provided with pawl teeth on the side facing collar C, now slides over sleeve D and interlocks with the outer teeth on collar C. With locknuts F and F1 tightened into place on both threaded ends of sleeve D, all parts now respond as a single unit from pressure on foot pedal being transferred to cam B via cogbelt AB.

Figure 2:
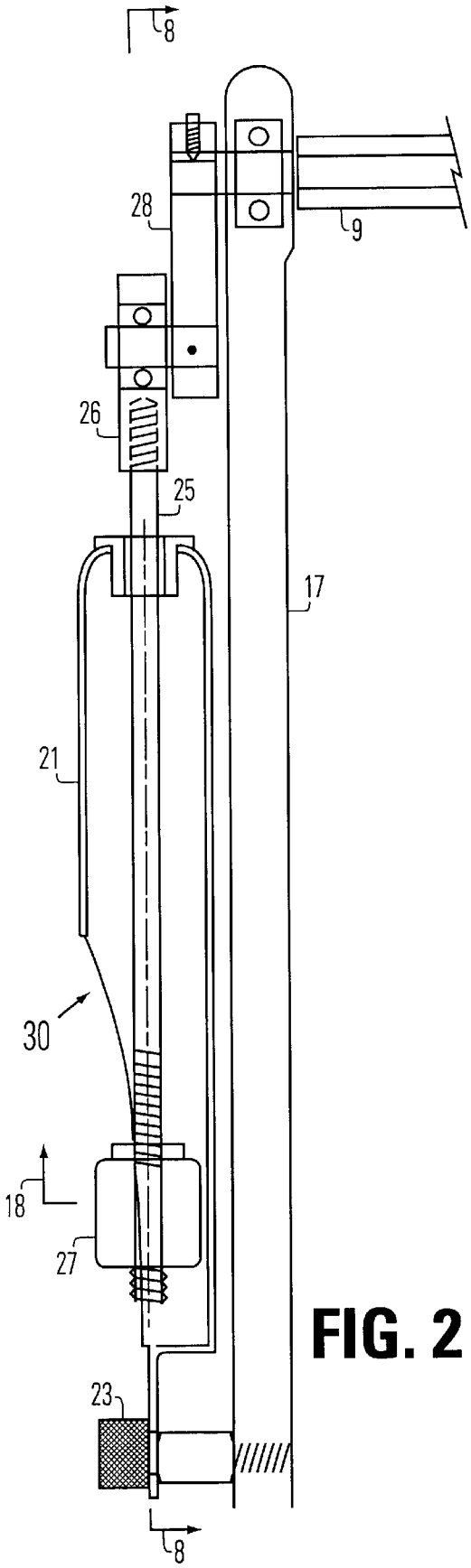
Figure 8:
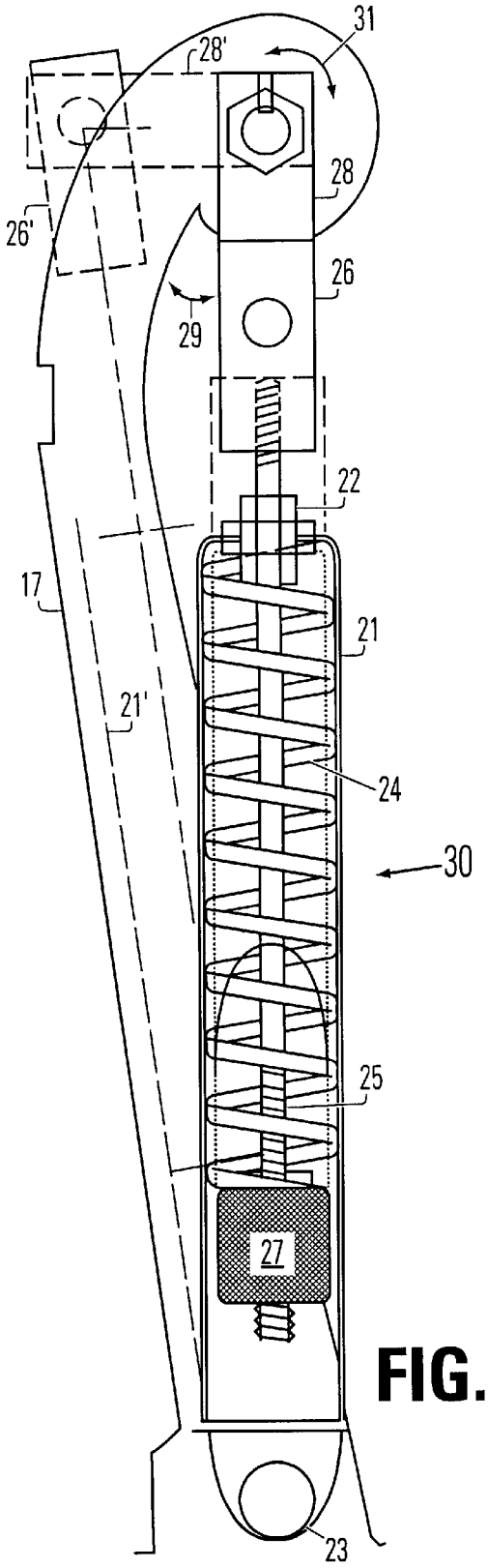

In FIG. 2 another aspect of the invention, an exterior mounted compression spring type spring arrangement for the return of the beater to a rest position, is provided. This tension preloading system for the beater and pedal allows for resistance pressure to be more evenly distributed, giving smoother reaction to pedal pressure. In addition to easier and faster tension setting, it also allows for a broader range of pressure parameters.

A preferred embodiment provides a replacement of conventional stretch type beater return spring with a compression spring. The original purpose of the stretch spring was simply to reset the beater arm to a rest position after each beat. Since then not much else appears to have been considered. With the tubular encased compression spring system, a much longer spring length can be accommodated. As with the stretch spring, a tension setting knurled nut is provided. In the compression system though, this nut acts as a preloading spring tension, except that a wider and smoother range of tension is now available prior to the sudden increase in resistance at the upper limits of spring compression. This results in a wider and smoother range of pressure parameters.

Tubular housing A is attached to base of pedal upright B with shoulder bolt C. Spring D is inserted in tube A along with threaded stem E which has been preassembled to rotor arm bearing F. Knurled tension nut G is then mounted and turned on threaded stem E to take up all slack and set the desired tension using thumb pressure only on knurled nut. Preloading occurs when spring length is shortened by tightening knurled nut; further compression of spring occurs when drummer depresses foot pedal causing rotation of upper rotor arm attached to axle shaft at top of pedal. This distance of compression is approximately and preferably ⅞ inch to 1 ⅛ inches, and establishes the desired upper limit spring resistance to foot pressure. It is these pressure ranges that are more evenly and smoothly distributed when employing longer spring lengths with desirable dynamic properties.

Figure 3:
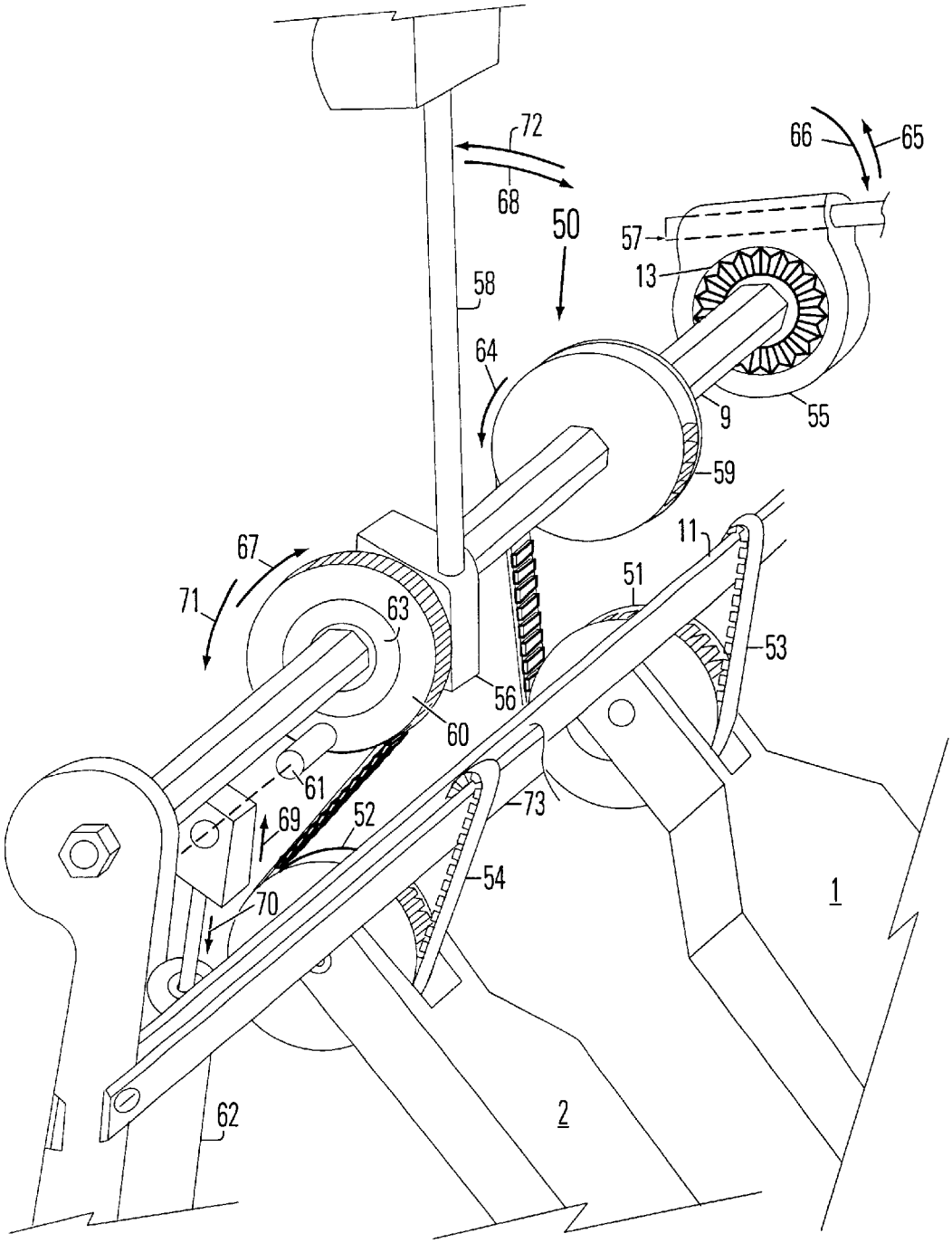

FIG. 3 shows an alternate embodiment employing a double beater. In this embodiment, pedal 1 is the normal down beat pedal and pedal 2 is the off beat pedal (see also FIGS. 4 and 5). The two pedals are preferably nested so they can fit into as close a side by side configuration as possible and to make it relatively easy for the drummer to engage both pedals with a single foot by simply swiveling the drum foot to cover both pedals. Like pedal 1, pedal 2 terminates in a toe pulley. Pulley 2 is operably connected by flexible member 2 to beater pulley 2 in a manner much like that for beater pulley 1, except that the wrap of member 2 around beater pulley 2 is the reverse of the wrap of member 1 around beater pulley 1. Beater pulley 2 is bearing mounted to the hex shaft of the assembly, so that the pulley is free to turn independently of the motion of the hex shaft. That is, pedal 1 can turn beater pulley 1 and the hex shaft, without turning beater pulley 2. Since beater shaft 2 is attached to beater pulley 2 and not to the hex shaft, it does not move appreciably when pedal 1 is depressed, unless pedal 2 is also depressed.

In operation (see discussion above for operation of that part of the mechanism comprising beater 1 alone), pedal 1 and pedal 2 are both depressed to ultimately produce both a down beat and an off beat. Pedal 2, via flexible member 2, turns beater pulley 2 in a direction opposite the direction in which pedal 1 is turning beater pulley 1 and beater 1, simultaneously, via shaft 2, compressing a spring in spring assembly 2, and drawing back beater 2 away from the drum head. When the pedal(s) are released, beater 1 returns to its rest position under the influence of spring assembly 1 on the hex shaft, and beater 2 moves to strike the drum under the influence of spring assembly 2 to complete the double beat cycle.

As with spring assembly 1, spring assembly two comprises preferably a compression type spring, and the compressing action is upward as illustrated in FIG. 2. Beater pulley 2 could also be eccentric, as well as substantially circular. The inner race of pulley 2's bearing is preferably mounted directly on the hex shaft.

Independent setup of the two beater pulleys is thus not required, because beat one essentially "charges up" the spring 2 for beat two in essentially the same magnitude as beat one. As long as the mechanical ratio of toe pulley 1 to beater pulley 1 is substantially the same as the ratio of toe pulley 2 to beater pulley 2, then with beater two upright and at rest, the strike of beater one on the drum charges beater two the same stroke, for approximately the same force of release Fess mechanical losses in the system). Beater two remains at rest in the vertical position when pedal 2 is not engaged.

Figure 4:
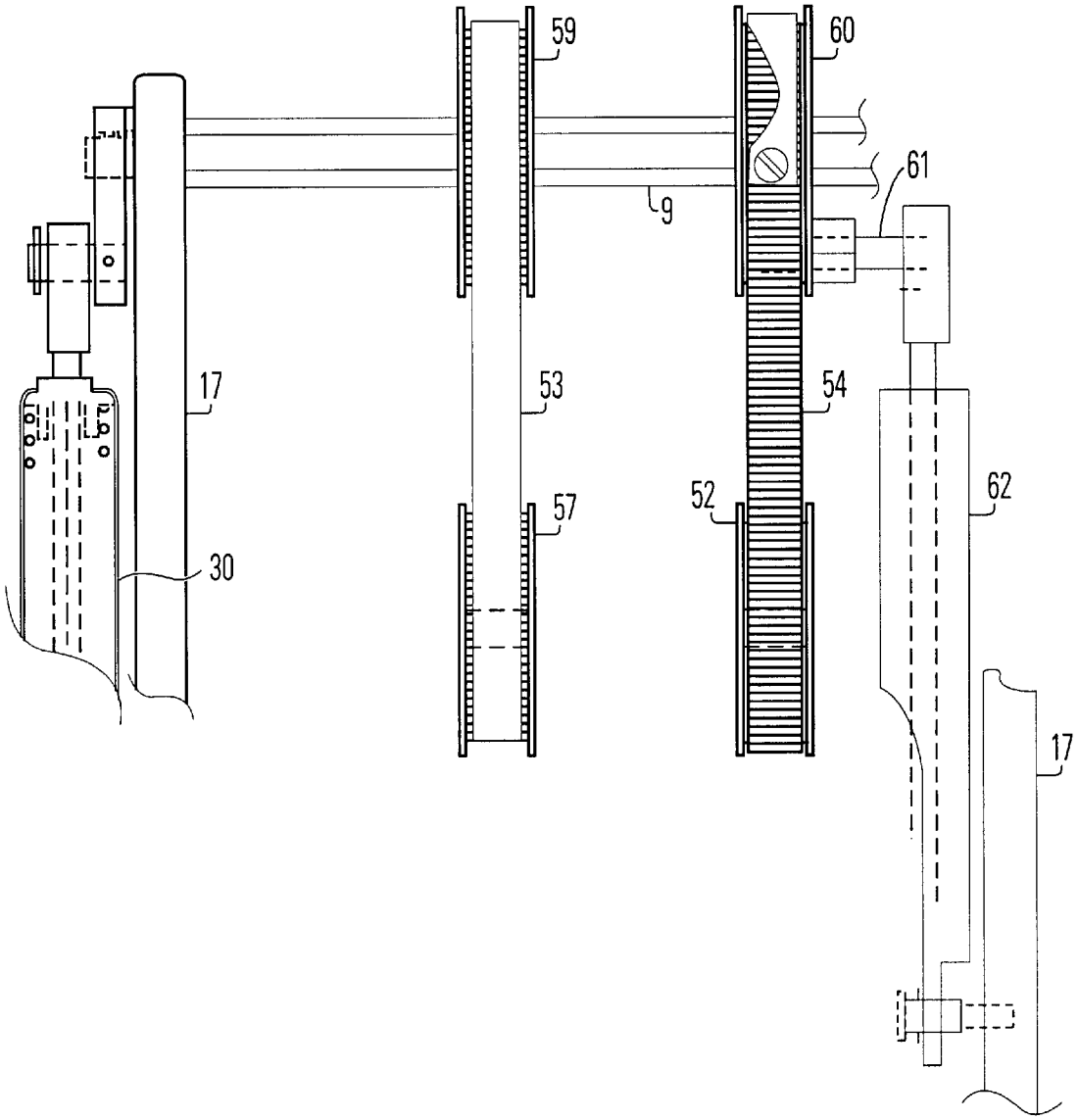
Figure 5:
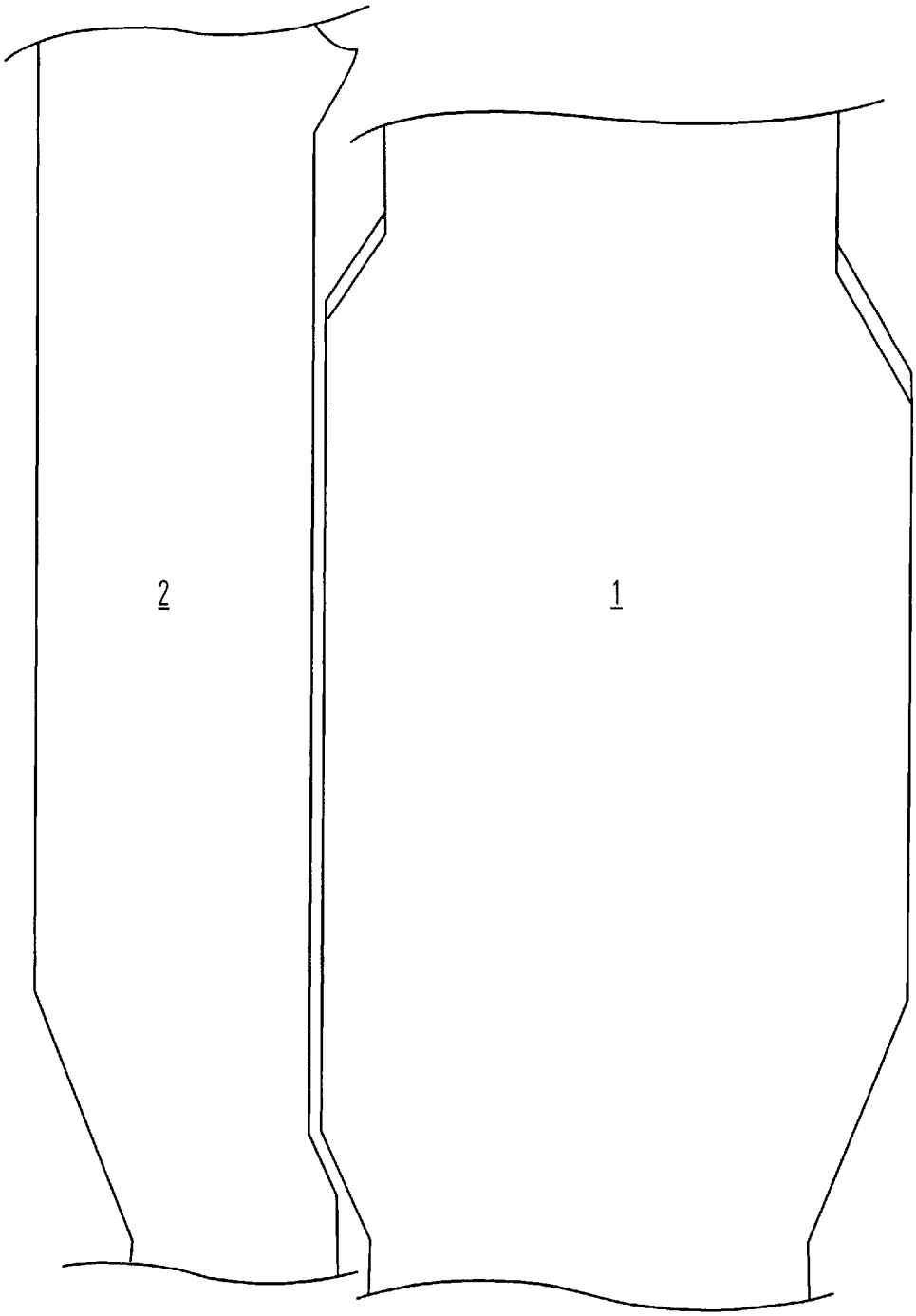
Figure 6:
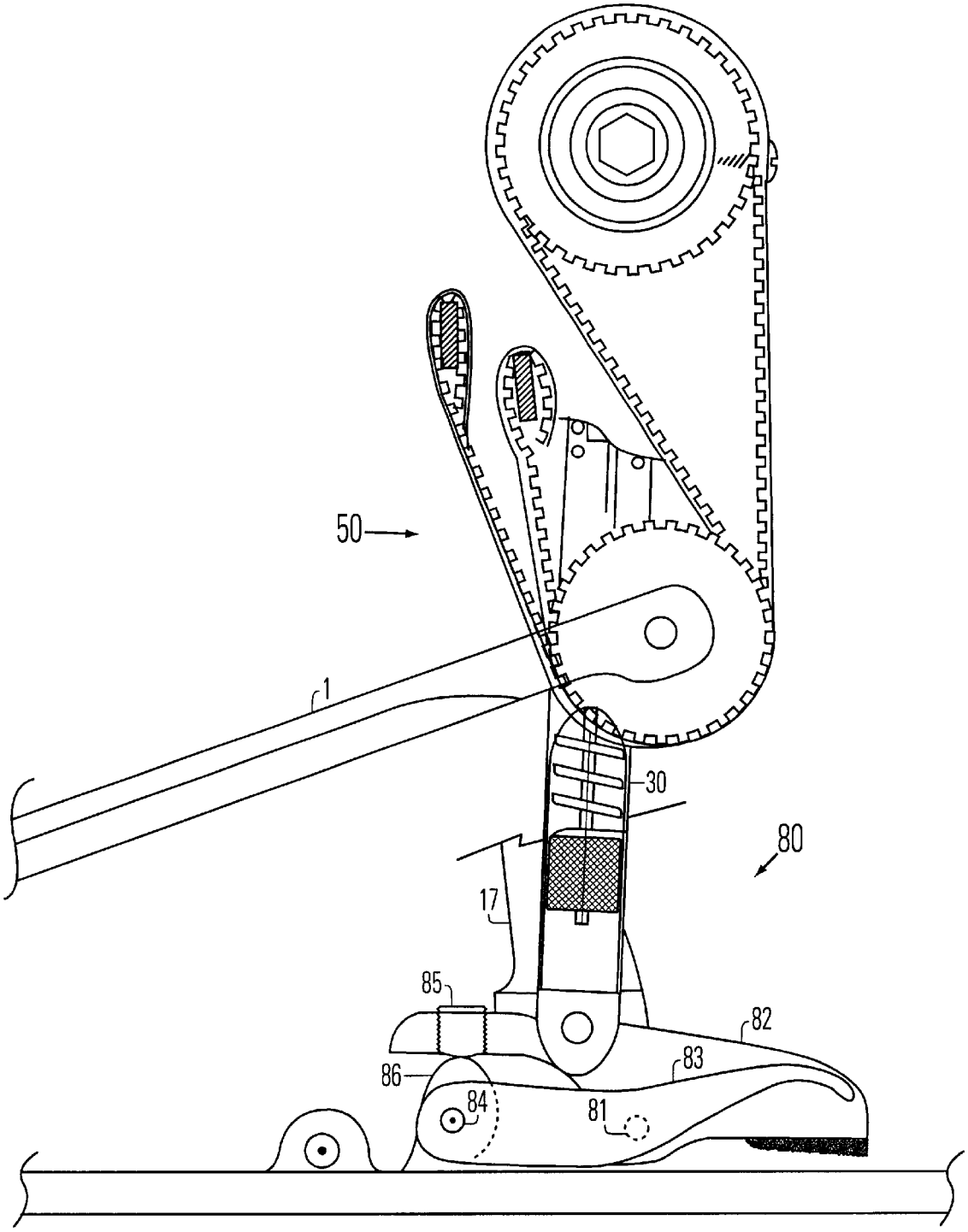

FIGS. 4 and 5 show reverse and forward views of the preferred nested pedal arrangement. FIG. 4 is a view from the other side of the apparatus as from the view of FIG. 3. FIG. 6 is a full profile view of the pedal, showing the quick set memory lock clamp feature of the invention. A memory lock clamping system for quickly attaching and detaching the pedal to the rim or hoop of the bass drum by a flick of a lever is provided. The clamp will retain the open and shut dimensions until necessary for attaching to different sized bass drum hoops. This is done by resetting the adjustment screw against the lever operated cam in a clamped on or closed position to release or lock the moveable locking member or clamping lever from or into position on the drum rim with the lock lever that engages and actuates the cam.

I claim:

1. An improved drum pedal system, the system comprising:

a. a crossarm axle rotatably mounted between two uprights;

b. two foot pedals, the toe ends of the foot pedals arranged generally aside each other and between the uprights and below the crossarm axle;

c. a pulley wheel mounted in each pedal toe end for rotation about an axis substantially parallel to the axis of the crossarm axle;

d. for each pedal toe end pulley wheel, an axle pulley wheel mounted upon the crossarm axle generally above it to define first and second pulley sets;

e. for each pulley set a flexible member connected at one end to a crossbar spanning the uprights, and wrapped around the pedal toe end pulley wheel and up around the corresponding axle pulley to an attachment point on the axle pulley;

f. each axle pulley inter operably engaged with a beater holder, each beater holder holding a beater, thus defining first and second pulley/beater sets, each pulley/beater set inter operably engaged with a spring mechanism such that any rotation of the pulley/beater set from a resting position stores a potential energy in the spring, further such that when the pulley/beater set is released from rotation, the potential energy in the spring restores the pulley/beater set to the resting position;

g. wherein the first pulley/beater set is rotatably mounted on the crossarm axle, such that downward motion applied to a first of the pedals produces a rotation of the first pulley/beater set toward a drum device, and wherein the second pulley/beater set is further rotatably mounted on the crossarm axle such that downward motion applied to a second of the pedals produces a reverse rotation of the second pulley/beater set away from the drum device, such that motion of the first pedal itself does not impart any significant motion to the second pulley/beater set thereby; and further h. wherein the reverse rotation of the second pulley/beater set away from the drum device is effected by reverse wrapping of the flexible member associated with the second pulley set, as compared to the wrapping of the flexible member associated with the first pulley set.

2. A drum pedal system beater positioning clutch, the clutch comprising a set of teeth on a face of a beater holder facing a beater pulley, and a set of engageably corresponding teeth on a face of the beater pulley facing the beater holder, whereby the beater holder and pulley are releasably interengaged for unitary movement in a first position relative to one another, and, by disengaging the beater holder teeth from the pulley teeth, they may be repositioned with respect to each other and then interengaged for unitary movement in a second position relative to one another.

* * * * *